US006053399A

United States Patent [19]

Wurdeman

[11] Patent Number: 6,053,399

[45] Date of Patent: Apr. 25, 2000

[54] DOUBLE FLAP POCKET MAILER AND ENVELOPE

[76] Inventor: Kimberly A. Wurdeman, 505 N. First, Plains, Kans. 67869

[21] Appl. No.: 09/192,914

[22] Filed: Nov. 16, 1998

[51] Int. Cl.[7] ..... B65D 27/28

[52] U.S. Cl. ..... 229/68.1; 229/75; 229/79; 229/92.5; 229/92.7; 229/116.2; D19/4

[58] Field of Search ..... 229/75, 79, 68.1, 229/116.2, 103.3, 92, 92.7, 92.5; D19/3, 4

[56] References Cited

U.S. PATENT DOCUMENTS

| | | | |
|---|---|---|---|
| 687,196 | 11/1901 | Cather | 229/80 |
| 764,653 | 7/1904 | Witte | 229/79 |
| 841,346 | 1/1907 | Sherman | 229/80 |
| 911,263 | 2/1909 | Peterson | 229/80 |
| 922,035 | 5/1909 | Pifer | 229/92.8 |
| 1,044,666 | 11/1912 | Kohlhof | 229/80 |
| 1,105,431 | 7/1914 | Hodgson | 229/79 |
| 1,121,922 | 12/1914 | Halsey | 229/80 |
| 1,142,444 | 6/1915 | Larson | 229/79 |
| 1,384,604 | 7/1921 | Doutney | 229/80 |
| 2,017,637 | 10/1935 | Smith | 229/92.5 |
| 2,298,601 | 10/1942 | Tremblett | 229/92.8 |
| 3,561,671 | 2/1971 | Minot, Jr. | 229/68.1 |
| 3,892,682 | 7/1975 | Florey | 229/92.8 |

FOREIGN PATENT DOCUMENTS

| | | | |
|---|---|---|---|
| 376756 | 4/1907 | France | 229/92.7 |

*Primary Examiner*—Stephen P. Garbe
*Attorney, Agent, or Firm*—Hovey, Williams, Timmons & Collins

[57] ABSTRACT

A double flap pocket mailer and envelope (20), having a back portion (22), first and second pocket flaps (24, 26), first and second closure flaps (28, 30), and a closure device (32) is utilized to deliver small items in an ornamentally shaped envelope. The first and second pocket flaps (24, 30) are connected with an adhesive (52) to form a pocket (50) for receiving items (34, 36). The first and second closure flaps (28, 30) are foldable between open and closed positions. The closure device (32) is held in a closure device receiving slit (66).

17 Claims, 1 Drawing Sheet

DOUBLE FLAP POCKET MAILER AND ENVELOPE

COPYRIGHT NOTICE AND AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

This invention relates to mailers and envelopes and, more particularly, to envelops and mailers for sending small sachets and photographs.

The card industry has grown greatly in recent years. It is now customary to mail cards for almost all holidays, events, and occasions, and it is also common to mail greeting cards for no particular occasion or event. Another popular form of greeting, especially at Christmas, is to send a photograph of the family or children, and for valentines day it is desirable to send a small scented sachet to convey the intended message of affection.

The cards, photographs, and sachets are typically inserted in a rectangular envelope for addressing and mailing. Thus, in addition to the cost of the item being mailed, there is the added cost of the envelope. Some photo mailers are like postcards. While postcard photo mailers are less expensive, they leave the photograph vulnerable to damage. Further, present envelope and card designs have failed to provide a configuration in which an enclosed item, especially a picture, is viewable without fully removing the item from the envelope or fully opening the card.

Another difficulty is encountered in mailing cards with ornamental shapes. These cards must be enclosed in envelopes large enough to receive the highest rectangular dimensions of the card. If odd shaped cards are mailed without envelopes, there is an unacceptably high probability of damage to the card.

Thus, it is desirable to provide a greeting card which can be mailed without an additional envelope. It is also desirable to provide a single sheet photo mailer which when opened allows viewing of the significant portions of the photograph. It is still further desirable to provide a card having an ornamental shape which can be folded into a mailable shape.

BRIEF SUMMARY OF THE INVENTION

There is, therefore, provided in the practice of the invention a novel double flap pocket mailer and envelope, which provides a single sheet mailer for delivery of photographs, sachets, and similar items. The mailer includes a back portion with four flaps. Two of the flaps are pocket flaps which fold over the back and are connected to form a pocket. The two other flaps are closure flaps which fold between open and closed positions to close the pocket.

In a preferred embodiment, the back portion is square, and the closure flaps comprise arcuate edges, so that an ornamental heart shape is formed when the closure flaps are in the open position. Further, the pocket flaps also have arcuate edges, so that an ornamental double heart shape is formed when the closure flaps are in the open position. The pocket flaps are preferably connected with an adhesive which substantially permanently connects the pocket flaps. The mailer is preferably provided with a closure device slit formed in an underlying one of the pocket flaps to receive and hold a closure device for later use. The pock et flaps are sized so that a significant portion of a photograph printed on or adhered to the back is visible above the pocket flaps.

There is further provided in the practice of the invention a novel blank for forming a single sheet mailer with a pocket. The blank includes a central back portion, first and second pocket flaps, and first and second closure flaps. The blank is preferably symmetrical, and each of the flaps preferably comprises an arcuate edge.

Accordingly, it is an object of the present invention to provide an improved mailer for delivery of photographs, sachets, or similar items.

BRIEF DESCRIPTION OF THE DRAWINGS

These and other inventive features, advantages, and objects will appear from the following Detailed Description of The Preferred Embodiments when considered in connection with the accompanying drawings in which similar reference characters denote similar elements throughout the several views and wherein.

DETAILED DESCRIPTION OF THE PREFERRED EMBODIMENTS

Figure 1:
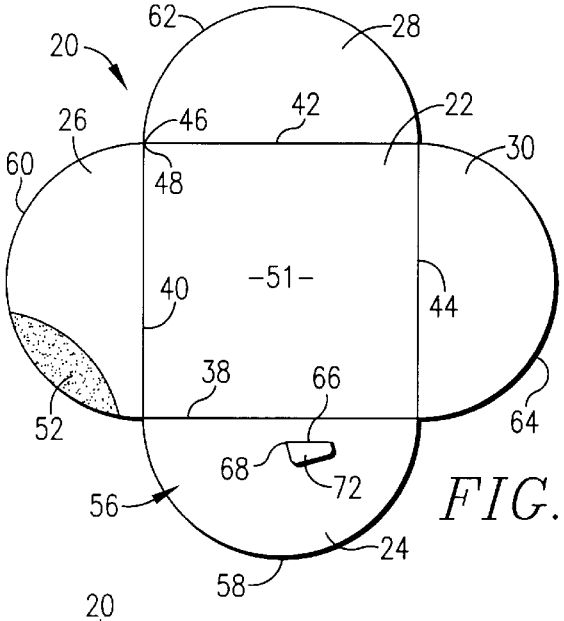
FIG. 1 is a unfolded front view of a double flap pocket mailer and envelope according to the present invention.
Figure 2:
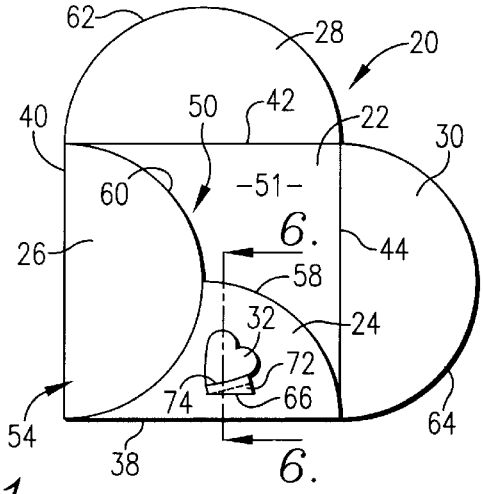
FIG. 2 is a front view of the mailer of FIG. 1 having pocket flaps thereof folded over to form a pocket.

Referring to the drawings in greater detail, FIGS. 1 and 2 show a double flap pocket mailer 20 having a generally central back portion 22, a pair of pocket flaps 24, 26, a pair of closure flaps 28, 30, and a closure device 32. The mailer 20 is formed of a single sheet blank, so that the back portion and flaps are integrally joined thereby providing a single sheet mailer for delivery of sachets 34 (FIG. 3), photographs 36 (FIG. 4), or other similar items.

The back portion 22 is a four sided polygon, preferably a square, and the back portion 22 includes a first pocket edge 38 formed by a first pocket scoreline, a second pocket edge 40 formed by a second pocket scoreline, a first closure edge 42 formed by a first closure scoreline, and a second closure edge 44 formed by a second closure scoreline. Because the edges and scorelines are essentially the same feature in the mailer, they will be identified with similar reference numerals. The scorelines are substantially linear, and the first pocket scoreline 38 is substantially parallel to and opposite the first closure scoreline 42. The second pocket scoreline 40 is substantially parallel and opposite to the second closure scoreline 44. Preferably, the scorelines and edges 38–44 have substantially identical lengths with ends of the adjacent edges intersecting at right angles. For example, the end 46 of the first closure edge 42 intersects the end 48 of the second pocket edge 40 at an angle of 90°.

The back portion 22 also includes a front wall 51, and a rear wall 53. The front wall 51 is the internal side of the back portion, and the rear wall is the external side of the back portion. The rear wall preferably comprises an address side of the mailer 20.

The pocket flaps 24, 26 are adjacent to each other and fold over the back portion to form a pocket 50 between the pocket flaps and the back portion. A connector 52, preferably an adhesive is applied between a first pocket overlap portion 54 and a second pocket overlap portion 56 to substantially permanently connect the first pocket flap to the second pocket flap. By substantially permanently it is meant that the first pocket flap cannot be separated from the second pocket flap without damaging the pocket flaps.

The first pocket flap 24 is contiguous with the back portion 22 along the first closure edge 42, and the second pocket flap 26 is contiguous with the back portion 22 along the second closure edge 44. The first pocket flap 24 comprises an underlying pocket flap, and the second pocket flap 26 comprises an overlying pocket flap. Thus, the second pocket flap overlies the first pocket flap. The first pocket flap comprises a first pocket arcuate edge 58, and the second pocket flap comprises a second pocket arcuate edge 60. The arcuate edges 58, 60 intersect the ends of the first and second pocket edges 38, 40. The arcuate edges are preferably half circles, which, when the pocket flaps 24, 26 are not folded over, substantially tangentially intersect the first and second closure edges 42, 44.

The closure flaps 28, 30 are adjacent to each other with the second closure flap 30 being opposite the second pocket flap 26, and the first closure flap 28 being opposite the first pocket flap 24. The first closure flap 28 is contiguous with the back portion 22 along the first closure edge 42, and the second closure flap 30 is contiguous with the back portion along the second closure edge 44. Both of the closure flaps are foldable between an open position shown in FIGS. 3 and 4 and a closed position shown in FIG. 5. The first and second closure flaps 28, 30 include a first closure arcuate edge 62 and a second closure arcuate edge 64, respectively. The arcuate edges 62, 64 are preferably half circles which intersect the first and second closure edges 42, 44 at their ends. The first and second closure arcuate edges 62, 64 also preferably tangentially intersect the first and second pocket edges 38, 40 when the closure flaps 28, 30 are in the open position.

Each of the four flaps comprises an apex or midpoint in their respective arcuate edges, and the flaps are sized and the arcuate edges configured so that the apexes are adjacent a geometric center of the back portion when the pocket flaps are folded over and the closure flaps are in the closed position. Thus, the apexes are spaced from the respective edges by sufficient distances to reach the geometric center of the back portion when the flaps are folded over. Further, each of the flaps preferably overlaps its two adjacent flaps, and each of the flaps is preferably the same size, so that the mailer 20 is symmetrical.

When the closure flaps are in the open position, the mailer is in the form of an ornamental heart shape. Further, the pocket flaps form another heart shape within the area of the back portion 22, so that an ornamental double heart shape is formed when the closure flaps are in the closure position and the pocket flaps are folded over to form the pocket 50. Thus, the single sheet mailer of the present invention provides a unique structure utilizing a single sheet to form a mailer having a pocket 50 and forming a unique and ornamental double heart shape.

Figure 3:
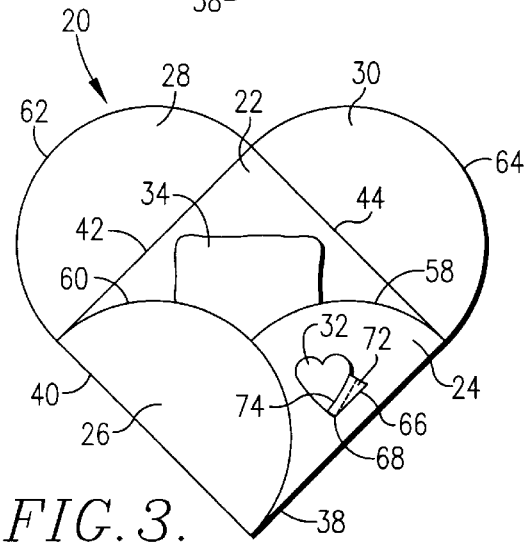
FIG. 3 is a front view of the mailer of FIG. 1 having a sachet held in the pocket.

Referring to FIG. 3, in a preferred embodiment, a sachet 34 is received in the pocket 50 and held therein by some type of fastener such as an adhesive. The scent of the sachet helps communicate the overall desired message communicated by the ornamental double heart shape of the mailer.

Figure 4:
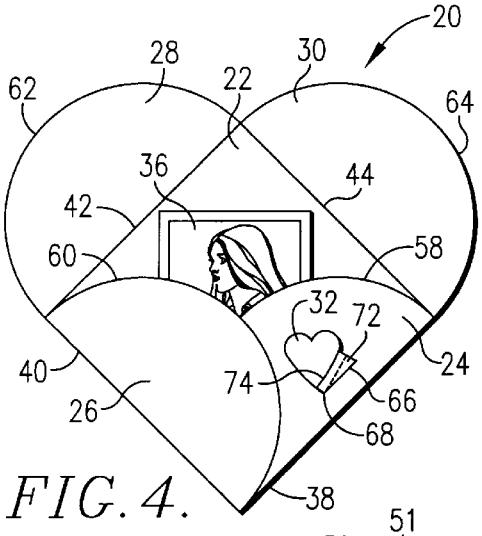
FIG. 4 is a front view of the mailer of FIG. 1 having a photograph inside the pocket.

Referring to FIG. 4, a photograph 36 can also be positioned inside the pocket. The photograph can be printed on the back portion of the mailer or be fastened to the front wall 51 of the back portion. The pocket flaps 24, 26 are sized so that a substantial portion of the front wall 51 is visible when the two closure flaps are opened. Thus, a significant portion of the photograph is visible above the pocket flaps. Thus, the important portions of the photograph such as the faces of the pictured individuals are clearly visible when the mailer is opened. This feature is provided by using only two pocket flaps instead of three as in a conventional envelope.

Figure 5:
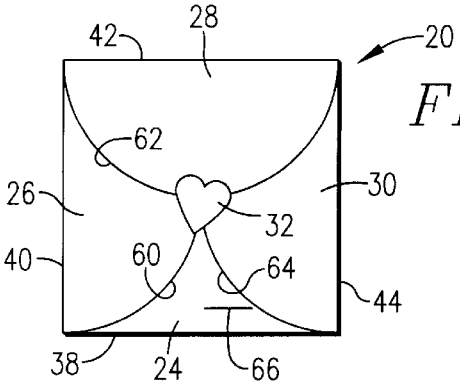
FIG. 5 is a front view of the mailer of FIG. 1 having closure flaps folded over to close the pocket.

Referring to FIG. 5, the mailer 20 is closed by folding the closure flaps 28, 30 over onto the back portion 22. Preferably, the second closure flap 30 is folded over first, and the first closure flap 28 is folded over next. Thus, the first closure flap 28 overlies all the other flaps. The closure device 32 is then placed near the geometric center of the back portion 22 on top of the flaps to hold the closure flaps 28, 30 in the closed position. Preferably, the closure device engages all of the flaps, and when the closure devices is torn or removed, the closure flaps are moved back to their open positions.

Figure 6:
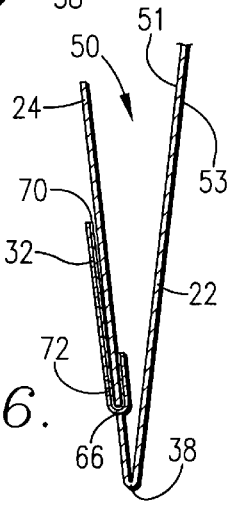
FIG. 6 is a fragmentary cross-sectional view taken along line 6—6 of FIG. 2 illustrating a closure device held in a closure slit.

Referring to FIGS. 2 and 6, the closure device 32 is preferably held in a closure device receiving slit 66 formed in a selected one of the back portion 22, first and second pocket flaps 24, 26, and first and second closure flaps 28, 30. Preferably, the slit 66 is formed in the underlying pocket flap 24, so that the closure device 32 is readily accessible for closing the mailer 20. The slit 66 is parallel to the first pocket edge 38 and the first closure edge 42, and the slit 60 is generally adjacent to the first closure edge 42. Further, the slit 66 is positioned closer to the second closure edge 44 than the second pocket edge 40 with an end 68 of the slit 66 being positioned substantially on a center line of the first pocket flap 24. The closure device 32, in keeping with the ornamental heart shapes, also has a heart shaped configuration. The closure device 32 preferably comprises an adhesively backed material held on a non-stick backing 70. The closure device 32 also includes a securement tab 72 which extends through the slit 66 and folds over to secure the closure device 32 to the pocket flap 24. The closure device 32 is simply peeled off of the non-stick backing 70 by separating the closure device 32 from the backing 70 along a separation line 74. Preferably, the securement tab 72 is made up of both non-stick backing 70 and the adhesively backed material.

The double flap pocket mailer and envelope 20 according to the present invention provides an improved single sheet mailer which forms a pocket 50 with only two flaps for delivering a sachet, photograph or similar item while presenting these items in a desired ornamental shape which, by means of two closure flaps, is readily folded into a mailable shape.

Thus, a double flap pocket mailer and envelope is disclosed which utilizes a single sheet to safely deliver small items in ornamentally shaped mailers thereby saving cost while enhancing the messages to be communicated by sending the items. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A combination gift mailer and greeting card product adapted when opened and viewed in a certain predetermined upright viewing orientation by a recipient of the product to communicate an expression of a sender to the recipient, said product comprising:

a generally central back panel including a first lower pocket edge and a second lower pocket edge converging downwardly to a lower point of intersection with one another, and a first upper closure edge and a second upper closure edge converging upwardly to an upper point of intersection with one another;

a first lower pocket flap joined to the back panel along the first pocket edge and folded over onto the back panel;

a second lower pocket flap joined to the back panel along the second pocket edge and folded over onto the back panel and part of the first lower pocket flap to form a region of overlap between the two lower pocket flaps;

a connector between the pocket flaps in said region of overlap substantially permanently connecting the flaps together to form a generally triangular, upright, open-top pocket between the back panel and the two pocket flaps, said pocket having, with respect to the upright viewing orientation of the product when opened, an open top, a closed bottom tip at said lower point of intersection of the pocket edges, and a pair of closed sides converting downwardly toward said tip along said pocket edges;

printed matter on the back panel, wherein the printed matter has right-side-up and upside-down orientations when viewed, said printed matter being in the right-side-up orientation when the product is oriented in the upright orientation so that the lower point of intersection is below the upper point of intersection;

a first upper closure flap joined to the back panel along said first closure edge and foldable between an unfolded, open position exposing the pocket and an inside surface of the first closure flap and a folded, closed position overlying the back panel and part of the open top of the pocket;

a second upper closure flap joined to the back panel along said second closure edge and foldable between an unfolded, open position exposing the pocket and the inside surface of the second closure flap and a folded, closed position overlying the back panel and the remaining part of the pocket top not covered by the first closure flap; and a closure device operable to releasably secure the closure flaps in their closed positions to at least one of the pocket flaps whereby to close the product for delivery, said closure flaps being unfoldable from their closed positions to their open positions after release of the closure device by a recipient of the product whereby to permit the recipient to view the printed matter and discern the sender's expression when the product is in the upright orientation.

2. The combination gift mailer and greeting card product according to claim 1 wherein the first closure flap comprises a first closure arcuate edge, the second closure flap comprises a second closure arcuate edge, the first pocket edge is substantially linear and substantially tangentially intersects the first arcuate edge of the first closure flap, and the second pocket edge is substantially linear and substantially tangentially intersects the second arcuate edge of the second closure flap, so that an ornamental heart shape is formed when the closure flaps are in the open position.

3. The combination gift mailer and greeting card product according to claim 2 wherein the first pocket flap comprises a first pocket arcuate edge, the second pocket flap comprises a second pocket arcuate edge, and the pocket arcuate edges intersecting near midpoints thereof, so that an ornamental double heart shape is formed when the closure flaps are in an open position and the pocket flaps are folded over.

4. The combination gift mailer and greeting card product according to claim 1 wherein the connector comprises an adhesive.

5. The combination gift mailer and greeting card product according to claim 1 wherein the back panel and flaps are integrally formed on a single sheet.

6. The combination gift mailer and greeting card product according to claim 1 wherein the first closure flap includes a first closure overlap portion, and the second closure flap includes a second closure overlap portion overlapping the first closure flap overlap portion when the closure flaps are folded into the closed positions.

7. The combination gift mailer and greeting card product according to claim 1 wherein the back panel is substantially square.

8. The combination gift mailer and greeting card product according to claim 1 further comprising a closure device slit formed in a selected one of the back panel and the flaps, said closure device being removably held within the closure device slit.

9. The combination gift mailer and greeting card product according to claim 8 wherein the closure device slit is formed in an underlying one of the pocket flaps.

10. The combination gift mailer and greeting card product according to claim 1, wherein the first closure flap has a first closure flap size and the second closure flap has a second closure flap size substantially the same as the first closure flap size, each closure flap presenting a closure apex that is adjacent a geometric center of the back panel when the closure flap is in the closed position.

11. The combination gift mailer and greeting card product according to claim 10 wherein the first and second pocket flap sizes are substantially the same as the first and second closure flap sizes.

12. The combination gift mailer and greeting card product according to claim 1 wherein each pocket flap comprises a pocket apex, and the pocket apexes are adjacent a geometric center of the back panel.

13. In combination:

a mailer including generally central back portion including a first pocket edge, a second pocket edge adjacent the first pocket edge, a first closure edge and a second closure edge adjacent the first closure edge, a first pocket flap contiguous with the back portion along the first pocket edge, the first pocket flap being folded over onto the back portion, and the first pocket flap having a first pocket overlap portion, a second pocket flap contiguous with the back portion along the second pocket edge, the second pocket flap being folded over onto the back portion, and the second pocket flap having a second pocket overlap portion overlapping the first pocket overlap portion of the first pocket flap, a connector between the first pocket overlap portion and the second pocket overlap portion substantially permanently connecting the first pocket flap to the second pocket flap to form a pocket between the back portion, the first pocket flap, and the second pocket flap, a first closure flap contiguous with the back portion along the first closure edge, the first closure flap being foldable between an open position and a closed position, a second closure flap contiguous with the back portion along the second closure edge, the second closure flap being foldable between an open position and a closed position, and a closure device centrally positionable on top of the closure flaps to hold the closure flaps in their closed position; and an item inside the pocket of the mailer, said item comprising a photograph adhered on the back portion, and a significant portion of the photograph is visible above the pocket flaps.

14. The combination according to claim 13 wherein each flap comprises an apex, and the apexes are adjacent a geometric center of the back portion when the closure flaps are in the respective closed positions.

15. In combination:

a mailer including generally central back portion including a second pocket edge, a second pocket edge adjacent the first pocket edge, a first closure edge, and a second closure edge adjacent the first closure edge, a first pocket flap contiguous with the back portion along the first pocket edge, the first pocket flap being folded over onto the back portion, and the first pocket flap having a first pocket overlap portion, a second pocket flap contiguous with the back portion along the second pocket edge, the second pocket flap being folded over onto the back portion, and the second pocket flap having a second pocket overlap portion overlapping the first pocket overlap portion of the first pocket flap, a connector between the first pocket overlap portion and the second pocket overlap portion substantially permanently connecting the first pocket flap to the second pocket flap to form a pocket between the back portion, the first pocket flap, and the second pocket flap, a first closure flap contiguous with the back portion along the first closure edge, the first closure flap being foldable between an open position and a closed position, a second closure flap contiguous with the back portion along the second closure edge, the second closure flap being foldable between an open position and a closed position, and a closure device centrally positionable on top of the closure flaps to hold the closure flaps in their closed position; and an item inside the pocket of the mailer, said item comprising a photograph printed on the back portion, and a significant portion of the photograph is visible above the pocket flaps.

16. In combination:

a mailer including generally central back panel including a first lower pocket edge and a second lower pocket edge converging downwardly to a lower point of intersection with one another, and a first upper closure edge and a second upper closure edge converging upwardly to an upper point of intersection with one another, a first lower pocket flap joined to the back panel along the first pocket edge and folded over onto the back panel, a second lower pocket flap joined to the back panel along the second pocket edge and folded over onto the back panel and part of the first lower pocket flap to form a region of overlap between the two lower pocket flaps, a connector between the pocket flaps in said region of overlap substantially permanently connecting the flaps together to form a generally triangular, upright, open-top pocket between the back panel and the two pocket flaps, said pocket having an open top for receiving and displaying a gift item inserted into the pocket, a closed bottom tip at said lower point of intersection of the pocket edges, and a pair of closed sides converging downwardly toward said tip along said pocket edges, a first upper closure flap joined to the back panel along said first closure edge and foldable between an unfolded, open position exposing the pocket and an inside surface of the first closure flap and a folded, closed position overlying the back panel and part of the open top of the pocket, a second upper closure flap joined to the back panel along said second closure edge and foldable between an unfolded, open position exposing the pocket and the inside surface of the second closure flap and a folded, closed position overlying the back panel and the remaining part of the pocket top not covered by the first closure flap, and a closure device operable to releasably secure the closure flaps in their closed positions to at least one of the pocket flaps whereby to close the product for delivery, said closure flaps being unfoldable from their closed positions to their open positions after release of the closure device; and an item having right-side-up and upside-down orientations when viewed, said item being arranged inside the pocket of the mailer so as to be in the right-side-up orientation when the mailer is oriented so that the lower point of intersection is below the upper point of intersection.

17. The combination according to claim 16 wherein the item comprises a photograph.

* * * * *